US007101239B1

(12) United States Patent
Torgerud et al.

(10) Patent No.: US 7,101,239 B1
(45) Date of Patent: Sep. 5, 2006

(54) FUEL FILTER LOCATED BELOW AN ADAPTER PLATE OF AN OUTBOARD MOTOR

(75) Inventors: Michael A. Torgerud, Mt. Calvary, WI (US); Timothy P. Wickman, Gladstone, MI (US); Troy J. Kollmann, Fond du Lac, WI (US); Brian L. Merten, Mt. Calvary, WI (US)

(73) Assignee: Brunswick Corporation, Lake Forest, IL (US)

( * ) Notice: Subject to any disclaimer, the term of this patent is extended or adjusted under 35 U.S.C. 154(b) by 167 days.

(21) Appl. No.: 10/913,971

(22) Filed: Aug. 6, 2004

(51) Int. Cl.
*F02B 61/04* (2006.01)

(52) U.S. Cl. ..... 440/88 F

(58) Field of Classification Search ..... 440/88 F
See application file for complete search history.

(56) References Cited

U.S. PATENT DOCUMENTS

| | | | | |
|---|---|---|---|---|
| 3,568,835 | A | 3/1971 | Hansen | 210/86 |
| 4,257,890 | A | 3/1981 | Hurner | 210/112 |
| 4,668,199 | A * | 5/1987 | Freund et al. | 440/89 R |
| 5,904,956 | A | 5/1999 | Kheyfets | 427/244 |
| 6,170,470 | B1 | 1/2001 | Clarkson et al. | 123/497 |
| 6,250,287 | B1 | 6/2001 | Wickman et al. | 123/497 |
| 6,253,742 | B1 | 7/2001 | Wickman et al. | 123/516 |
| 6,326,895 | B1 * | 12/2001 | Hartke et al. | 340/612 |
| 6,390,871 | B1 | 5/2002 | Wickman et al. | 440/88 |
| 6,527,603 | B1 | 3/2003 | Wickman et al. | 440/88 |
| 6,553,974 | B1 | 4/2003 | Wickman et al. | 123/516 |
| 6,669,239 | B1 | 12/2003 | Entringer et al. | 285/215 |
| 6,718,953 | B1 | 4/2004 | Torgerud | 123/516 |

* cited by examiner

*Primary Examiner*—Ed Swinehart
(74) *Attorney, Agent, or Firm*—William D. Lanyi

(57) ABSTRACT

A marine propulsion device is provided with a fuel filter that is connectable between a fuel tank and a fuel pump, wherein the fuel filter is disposed below an adapter plate of the marine propulsion device. The adapter plate is located between the fuel filter and the engine so that the fuel filter is not located under the cowl of the marine propulsion device where an engine is housed.

19 Claims, 3 Drawing Sheets

FUEL FILTER LOCATED BELOW AN ADAPTER PLATE OF AN OUTBOARD MOTOR

BACKGROUND OF THE INVENTION

1. Field of the Invention

The present invention relates generally to a fuel filter for an outboard motor and, more particularly, to a water separating fuel filter that is located below an adapter plate of an outboard motor.

2. Description of the Prior Art

Those skilled in the art of marine propulsion systems are familiar with the use of water separating fuel filters. It is also known that various components of a fuel supply system for an outboard motor are subjected to significant heat emitted from an engine if they are located under the cowl of the outboard motor. This heat soak condition typically occurs when the engine is turned off after an extended period of use. Heat stored in the engine and its oil supply raises the temperature of components located under the cowl. Components of the fuel system can therefore experience a condition referred to as "vapor lock" in which liquid fuel vaporizes within components and conduits of the fuel supply system and the existence of vapors within these components create a difficulty for pumps to induce the flow of the vapor into an inlet of the pump. It would therefore be significantly beneficial if the major components of an engine's fuel system could be located outside of the cowl and away from the heat producing components associated with the engine.

U.S. Pat. No. 3,568,835, which issued to Hansen on Mar. 9, 1971, describes a liquid separator and filter unit. The apparatus is intended for separating water and other foreign material from a liquid such as diesel fuel and then filter the fuel. It comprises a container having an inlet at its upper end for the liquid to be treated and means for subjecting the incoming fluid to the action of sufficient centrifugal force to separate water and heavier dirt particles from the fuel and cause the water and dirt particles to settle into the lower portion of the container.

U.S. Pat. No. 4,257,890, which issued to Hurner on Mar. 24, 1981, describes a fuel water separator. The device separates water from diesel fuel and is adapted to be used with conventional fuel filter fittings and consists of a conical screen-like member which serves to separate the water from the fuel and in which the inlet providing the fuel which may have water therein is interior of the downwardly diverging conical member.

U.S. Pat. No. 5,904,956, which issued to Kheyfets on May 18, 1999, describes a filter for separating water from fuel. The filter includes fibers rendered hydrophobic with a silane surface treatment preceded by contact with a cationic surfactant in an aromatic hydrocarbon solvent.

U.S. Pat. No. 6,170,470, which issued to Clarkson et al. on Jan. 9, 2001, discloses a fuel supply system for an internal combustion engine. The system provides first and second conduits that draw fuel from first and second positions, or locations, within a fuel reservoir. If water exists in the fuel reservoir, the second position is selected to be lower in the fuel reservoir than the first position so that accumulated water will be drawn through the second conduit under certain conditions, such as when the engine is operating at a speed above the minimum threshold. The fuel reservoir can be fuel tank or auxiliary fuel tank of a vehicle or watercraft or, alternatively, it can be the housing of a fuel/water separator.

U.S. Pat. No. 6,250,287, which issued to Wickman et al. on Jun. 26, 2001, discloses a fuel delivery system for a marine engine. A fuel pump is housed within the structure of a portable fuel tank. The inlet of the pump is located in the lower portion of the tank and an outlet of the pump is connectable in fluid communication with a flexible conduit. An opposite end of the flexible conduit is connectable in fluid communication with the fuel system of the outboard motor. A water sensor and a fuel level sensor can be provided in conjunction with the pump and attached to the pump in certain embodiments. A fuel pressure regulator is connected in fluid communication with the outlet of the pump and also located within the structure of the portable fuel tank.

U.S. Pat. No. 6,253,742, which issued to Wickman et al. on Jul. 3, 2001, discloses a fuel supply method for a marine propulsion engine. A method for controlling the operation of a fuel system of an outboard motor uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

U.S. Pat. No. 6,390,871, which issued to Wickman et al. on May 21, 2002; discloses fuel reservoir mounted to a drive shaft housing of an outboard motor. A fuel system for a marine propulsion system includes a reservoir that defines a cavity in which first and second fuel pumps are disposed. The reservoir is mounted on the marine propulsion system at a location which causes the reservoir to be at least partially submerged within, and in thermal communication with, water in which the marine propulsion system is operated when a propulsor of the marine propulsion system is inactive. The first fuel pump is a lift pump which draws fuel from a fuel tank and pumps the fuel into the cavity of the reservoir. The second fuel pump is a high pressure pump which draws fuel from the cavity and pumps the fuel at a higher pressure to a fuel rail of an engine.

U.S. Pat. No. 6,527,603, which issued to Wickman et al. on Mar. 4, 2003, discloses a fuel delivery system for a marine propulsion device. A fuel system for a marine propulsion system includes a reservoir that defines a cavity in which first and second fuel pumps are disposed. The first fuel pump is a lift pump which draws fuel from a fuel tank and pumps the fuel into the cavity of the reservoir. The second fuel pump is a high pressure pump that draws fuel from the cavity and pumps the fuel at a higher pressure to a fuel rail of an engine.

U.S. Pat. No. 6,553,974, which issued to Wickman et al. on Apr. 29, 2003, discloses an engine fuel system with a fuel vapor separator and a fuel vapor vent canister. A fuel supply system for a marine engine provides an additional fuel chamber, associated with a fuel vapor separator, that receives fuel vapor from a vent of the fuel vapor separator. In order to prevent the flow of a liquid fuel into and out of the additional fuel chamber, a valve is provided which is able to block the vent of the additional chamber. In addition, a sensor is provided to provide a signal that represents a condition in which liquid fuel within the additional fuel chamber exceeds a predetermined level.

U.S. Pat. No. 6,669,239, which issued to Entringer et al. on Dec. 30, 2003, discloses a sealing device for a conduit passing through a wall. A device is provided for allowing a conduit to extend through a wall while providing a seal around the conduit. The conduit extends through an opening formed in the wall and the conduit has a first end, a second end, and a central axis extending within the cavity of the conduit and along its length. First and second protrusions of the first end of the conduit are shaped to be received through first and second slots of the opening formed through the wall. A resilient seal member is attached to the first end of the conduit and is compressible by moving the conduit out of a first position relative to the opening in which the first and second protrusions are aligned with the first and second slots. By moving the conduit away from its first position, the resilient seal member is compressed to provide a liquid seal which prevents liquid from leaking through the opening formed through the wall.

U.S. Pat. No. 6,718,953, which issued to Torgerud on Apr. 13, 2004, discloses a fuel vapor separator with a flow directing component within a fuel recirculating flow path. A fuel delivery system for a marine engine provides first, second, and third reservoirs of a fuel vapor separator and first, second, and third pumps to cause fuel to be drawn from the fuel tank and provided to the combustion chambers of an internal combustion engine. A flow directing component is provided to inhibit recirculated fuel from mixing directly with fuel within the fuel vapor separator that has not yet been pumped to a fuel rail. The flow directing component receives recirculated fuel and also receives fuel from a second reservoir through an orifice formed through a surface of the flow directing component.

The patents described above are hereby expressly incorporated by reference in the description of the present invention.

SUMMARY OF THE INVENTION

A marine propulsion device, made in accordance with a preferred embodiment of the present invention, comprises an engine, a drive shaft housing, and an adapter plate disposed beneath the engine and above the drive shaft housing. It also comprises a fuel filter which is connectable between a fuel tank and a fuel pump. The fuel filter is disposed below the adaptor plate with the adaptor plate disposed between the fuel filter and the engine.

The fuel filter can be a water separating fuel filter. The marine propulsion device can further comprise a fuel reservoir, such as a fuel supply module, wherein the fuel filter is connected in fluid communication between the fuel reservoir and the fuel tank. The fuel pump can be disposed within the fuel reservoir.

In a preferred embodiment of the present invention, it can further comprise a conduit connected in fluid communication with the fuel filter and a manually operable pump connected in fluid communication with the fuel filter. The conduit can extend through the adapter plate.

The fuel filter can be provided with an inlet port, an outlet port, and a filter media disposed in fluid communication between the inlet and outlet ports. The marine propulsion device can further comprise a purge pump and a conduit connected in fluid communication between a purge port of the fuel filter and the purge pump. The conduit can extend through the adapter plate and the filter media can be disposed in fluid communication between the purge port and the outlet port of the fuel filter. In certain embodiments of the present invention, the inlet port and the purge port are the same opening of the fuel filter. The purge pump can be a manually operable pump and can comprise a compressible bulb. A valve can be connected in fluid communication with the conduit. The valve can be a Schraeder valve.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
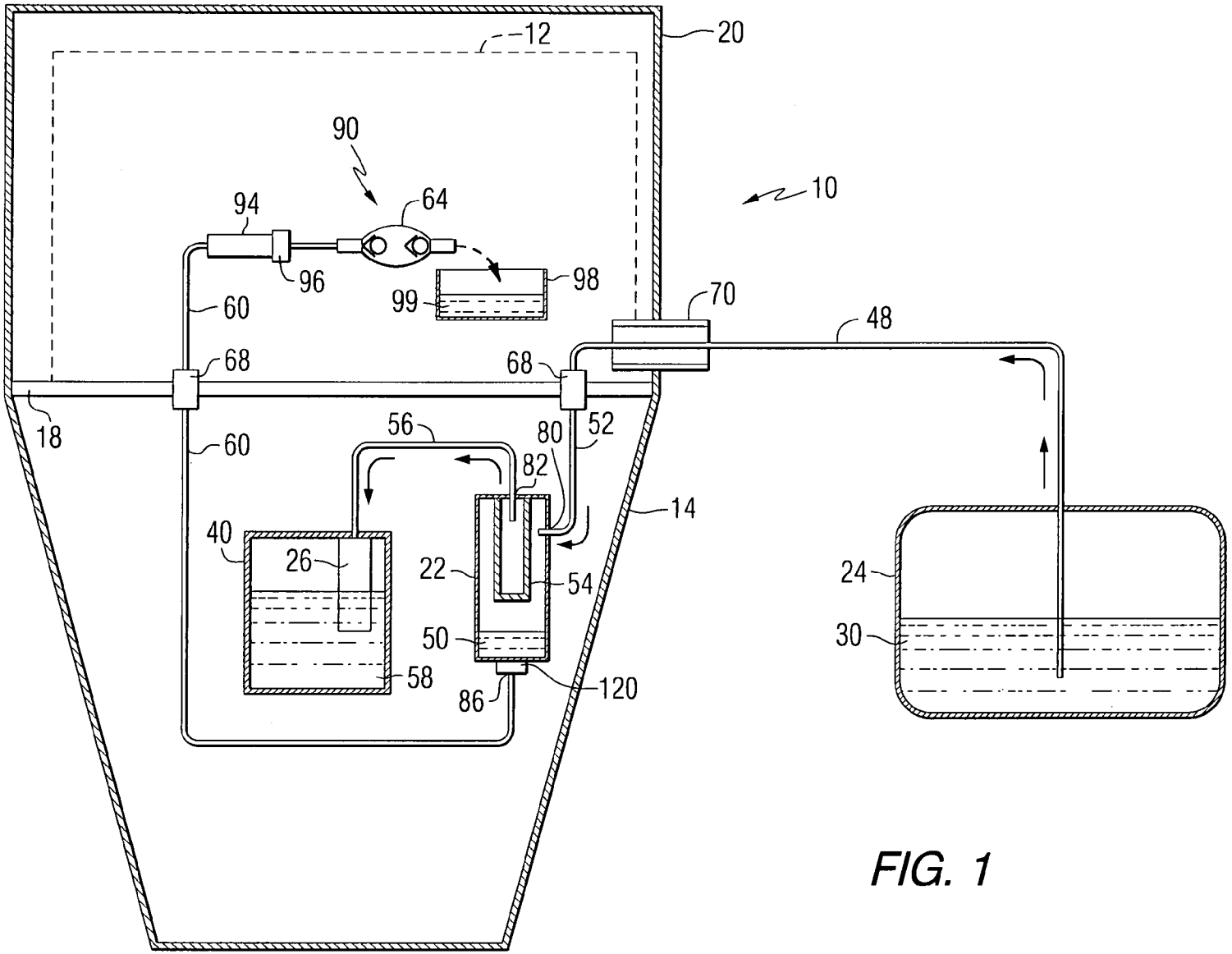
FIGS. 1 and 2 show simplified schematic representations of the present invention.

Throughout the description of the preferred embodiment of the present invention, like components will be identified by like reference numerals.

FIG. 1 is a highly schematic representation of a marine propulsion device 10, such as an outboard motor, incorporating a preferred embodiment of the present invention. It comprises an engine 12, represented by dashed lines in FIG. 1, a drive shaft housing 14 and an adapter plate 18 which is disposed beneath the engine 12 and above the drive shaft housing 14. Those skilled in the art of marine propulsion systems are familiar with the use of a cowl 20 to enclose the engine 12 and its associated components. Although not shown in FIG. 1, the drive shaft housing 14 typically encloses structures that support a drive shaft for rotation about a vertical axis. A fuel filter 22 is connectable between a fuel tank 24 of a marine vessel and a fuel pump 26. The fuel pump 26 is sometimes referred to as a "lift pump" and its primary function is to draw liquid fuel 30 from the fuel tank 24, in a direction represented by arrows in FIG. 1, and induce the flow of that liquid fuel into a fuel supply module 40, or fuel vapor separator. The fuel filter 22 is disposed below the adapter plate 18 in a preferred embodiment of the present invention with the adapter plate 18 disposed between the fuel filter 22 and the engine 12. It should be understood that in known structures of outboard motors, the fuel filter 22 is located under the cowl 20 and above the adapter plate 18. The conventional location of the fuel filter 22, above the adapter 18 and under the cowl 20, subjects the filter 22 to exposure to high temperatures, particularly after the engine 12 is operated for extended periods of time and then turned off. Heat from the engine 12 and associated components continues to be emitted and the cavity under the cowl 20 is subjected to significant temperatures for a prolonged period of time subsequent to the engine 12 being turned off. This raises the temperature of those components under the cowl 20 and, in the case of a fuel filter 22, can raise the temperature of the fuel within the filter 22 above its boiling point. This creates the disadvantageous condition of gaseous vapor in the fuel filter 22 and its associated conduits above the adapter plate 18. The presence of fuel vapor within these structures increases the likelihood that vapor lock will occur when an attempt is made to restart the engine 12. That presence of gaseous fuel in components above the adapter plate 18 can increase the likelihood that the fuel pump 26 will be unable to draw fuel through the fuel line 48 from the fuel tank 24. The preferred embodiment of the present invention places the fuel filter 22 below the adapter plate 18 to remove it from the space under the cowl 20 that is subjected to this type of heating.

In a preferred embodiment of the present invention, the fuel filter 22 is a water separating fuel filter. This characteristic is represented by the quantity of water 50 located in the bottom portion of the fuel filter. Under normal operation, fuel flows into the fuel filter 22 through conduit 52 and passes through the filter media 54 toward a central portion of the fuel filter structure. Fuel passes through the media 54 and is drawn through conduit 56 by the pump 26. After passing through the pump 26, liquid fuel 58 is collected in the bottom portion of the fuel supply module 40. It should be understood that other components are typically contained within the fuel supply module 40, but are not shown in FIG. 1. U.S. Pat. Nos. 6,527,603 and 6,718,953 illustrate fuel supply modules in greater detail and explain the components that are contained within them.

With continued reference to FIG. 1, the fuel system that conducts fuel from the fuel supply module 40 to the engine is not illustrated in FIG. 1. Those components are not directly related to the operation or structure of a preferred embodiment of the present invention.

As shown in FIG. 1, the fuel supply module 40, or fuel reservoir, contains the fuel pump 26. The fuel filter 22 is connected in fluid communication between the fuel reservoir 40 and the fuel tank 24. A conduit 60 is connected in fluid communication with the fuel filter 22 and, more specifically, with a bottom portion of the fuel filter 22. A manually operated pump 64 is connected in fluid communication with the conduit 60 and the fuel filter 22. The conduit 60 extends through the adapter plate 18 as shown. To facilitate the extension of conduits through the adapter plate 18, bulkhead fittings are used. Fittings that are suitable for these purposes are described in detail in U.S. Pat. No. 6,669,239. These bulkheads are shown in FIG. 1 in association with the conduit 60 and also with the fuel line 52. The fuel line 48 which leads from the fuel tank 24 to the bulkhead 68 passes through a tubular structure 70 that extends through the cowl 20. This tubular structure is a rigging tube through which numerous wires and conduits can pass so that they can be connected to the components under the cowl 20 and within the drive shaft housing 14 and also to various devices within the marine vessel. The fuel tank 24 is typically stored within the structure of the marine vessel and external to the outboard motor 10.

With continued reference to FIG. 1, the fuel filter 22 has an inlet port 80 an outlet port 82 and the filter media 54 which is disposed in fluid communication between the inlet and outlet ports, 80 and 82. A purge pump 90 is provided and connected in fluid communication with the conduit 60. As described above, the purge pump can be a manually operated bulb 64. The conduit 60 is connected in fluid communication between a purge port 86 of the fuel filter 22 and the purge pump 90. Because the conduit 60 extends through the adapter plate 18, the purge pump 90 can be located above the adapter plate 18 with the fuel filter 22 located below the adapter plate 18. The filter, media 54 is disposed in fluid communication between the purge port 86 and the outlet port 82 of the fuel filter 22. It should be understood that the purge port 86 and the inlet port 80 can be connected directly together in certain embodiments of the present invention and, if appropriate, can be a common opening in the fuel filter 22. As described above, the purge pump 90 can be a manually operable pump and, as illustrated in FIG. 1, can be compressible bulb 64. A valve 94 is connected in fluid communication with the conduit 60 in a preferred embodiment of the present invention. This valve 94 can be a Schraeder valve and a threaded cap 96, which is connected to the bulb 64, can be removably attached to the Schraeder valve 94 to allow the water 50 to be drawn out of the fuel filter 22 into a temporary container 98. This allows an operator to manually draw water through conduit 60 and through the Schraeder valve 94 through the action of the manually operated bulb 64. The water can be collected in the container 98 and disposed of. After the water 50 in the fuel filter 22 is removed through conduit 60 and disposed of in container 98, the threaded cap 96 can be removed from the Schraeder valve 94 and the manually operated pump 90 can be stored for future use.

Figure 2:
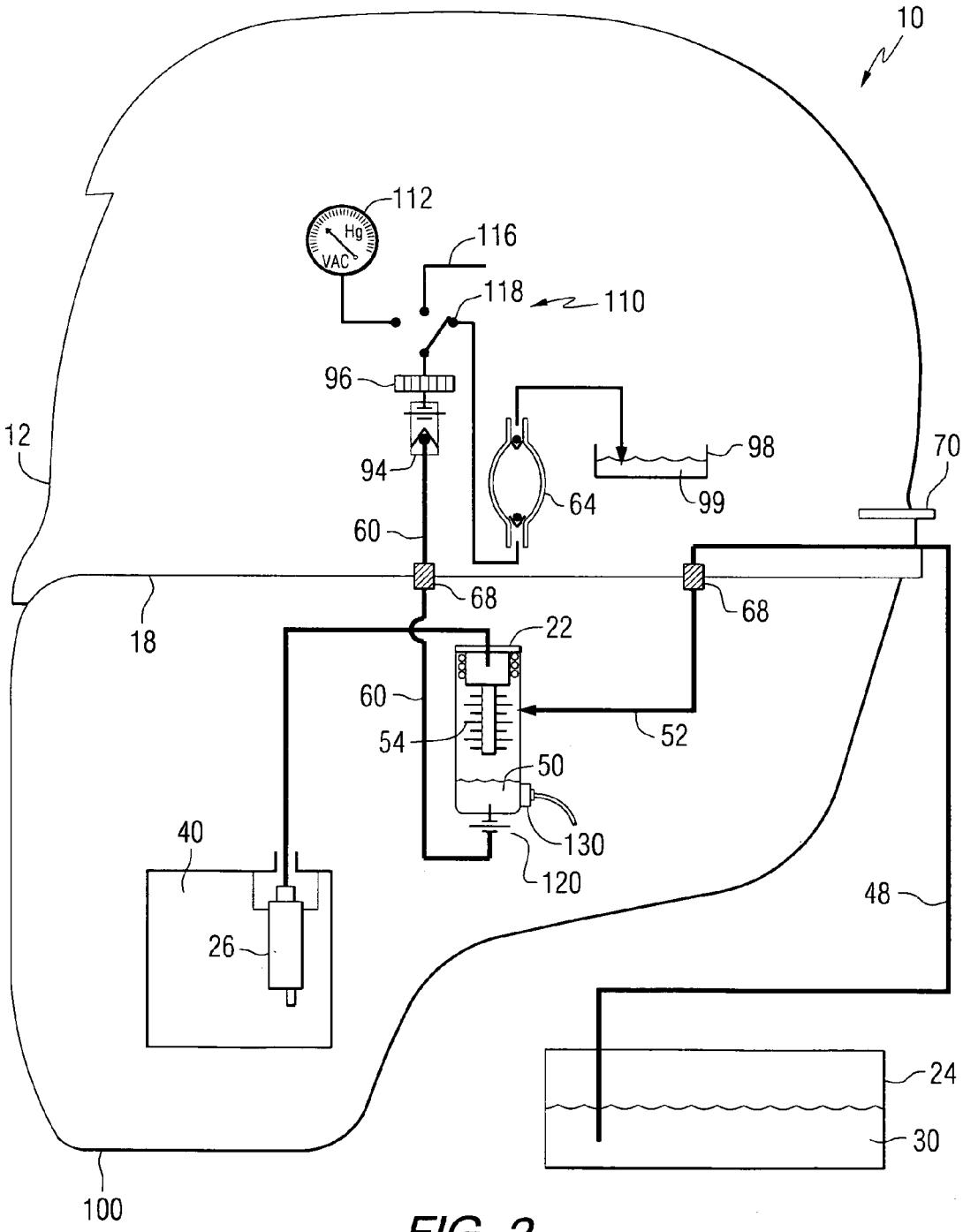

FIG. 2 is a representation of a marine propulsion system 10 showing the preferred embodiment of the present invention in a slightly different representation. In FIG. 2, a three position selector valve 110 is provided to permit an operator to connect a vacuum gauge 112 to the Schraeder valve 94 for the purpose of measuring the pressure in conduit 60. Another position of the selectable valve 110, identified by reference numeral 116, provides a bleed port though which a service technician can remove fluid from the system. The third position 118 is the connection by which the manually operable pump 90, or purge pump, is connected to the Schraeder valve 94. The threaded cap 96 is also illustrated between the Schraeder valve 94 and the three position valve 110. A screen 120 can be provided at the purge port 86 to prevent residue or debris from passing with the water 50 through conduit 60 and possibly blocking the internal mechanism of the Schraeder valve 94.

With continued reference to FIGS. 1 and 2, it can be seen that a marine propulsion device made in accordance with a preferred embodiment of the present invention comprises an engine 12, a drive shaft housing 14, an adapter plate 18 disposed beneath the engine 12 and above the drive shaft housing 14, and a fuel filter 22 which is connectable between a fuel tank 24 and a fuel pump 26. The fuel filter 22 is disposed below the adapter plate 18 with the adapter plate 18 disposed between the fuel filter 22 and the engine 12. The fuel filter 22 is a water separating fuel filter in a preferred embodiment of the present invention. The system can further comprise a fuel reservoir 40, such as a fuel supply module, and the fuel filter 22 can be connected in fluid communication between the fuel reservoir 40 and the fuel tank 24. The fuel pump 26 can be disposed within the fuel reservoir 40. A conduit 60 is connected in fluid communication with the fuel filter 22 and a manually operable pump 90 is connected in fluid communication with the fuel filter 22 and the conduit 60. The conduit 60 extends through the adapter plate 18. The fuel filter 22 has an inlet port 80, an outlet port 82, and a filter media 54 that is disposed in fluid communication between the inlet and outlet ports. A purge pump 90, which can comprise a manually operable compressible bulb 64 is provided and a conduit 60 is connected in fluid communication between the purge port 86 of the fuel filter 22 and the purge pump 90. As a result, the filter media 54 is disposed in fluid communication between the purge port 86 and the outlet port 82 of the filter 22. In some embodiments of the present invention, the inlet port 80 and the purge port 86 can be a common port. The Schraeder valve 94 is connected in fluid communication with the conduit 60.

With continued reference to FIGS. 1 and 2, a preferred embodiment of the present invention can also comprise a screen component 120 and, in certain embodiments, a water sensor 130.

Figure 3:
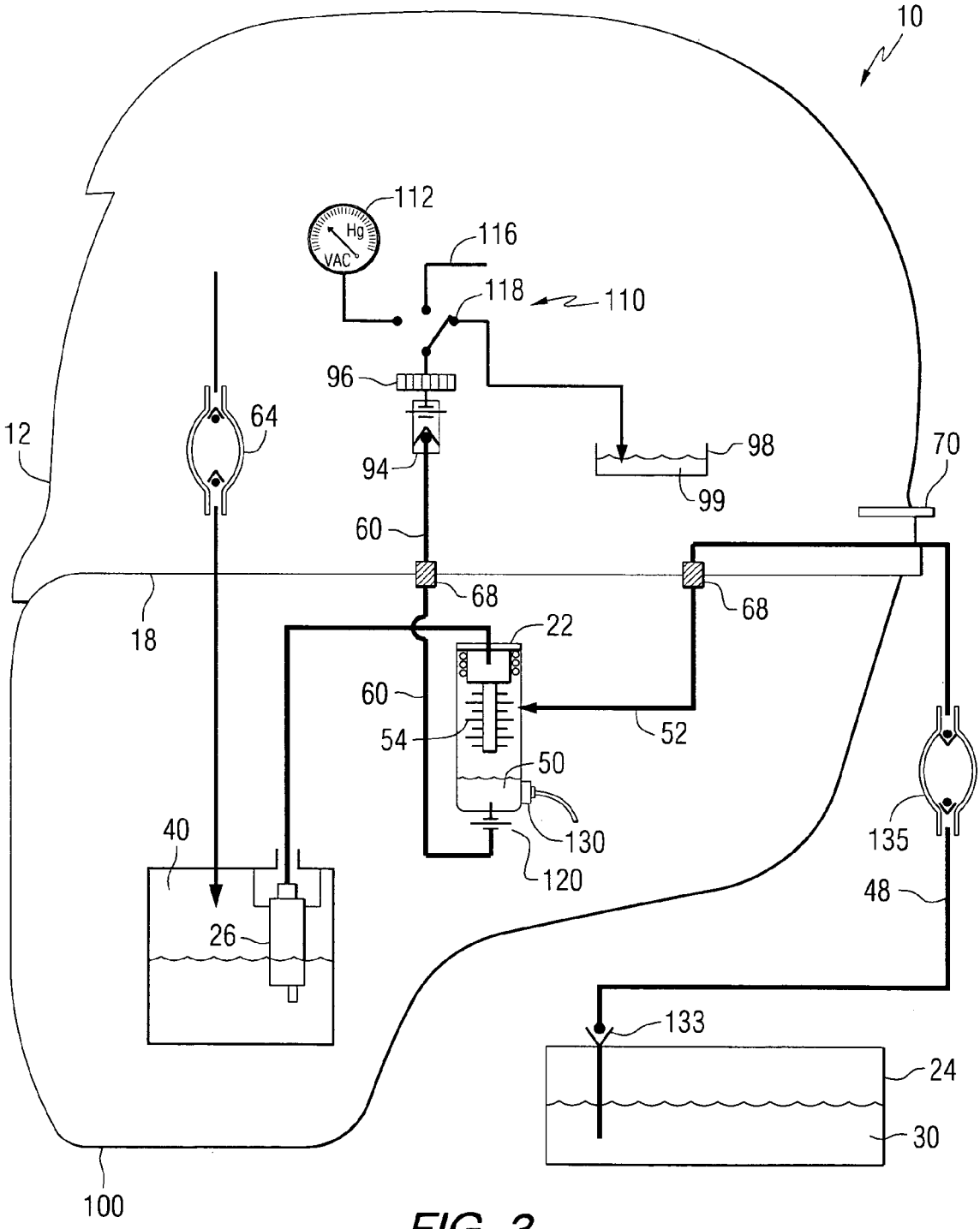
FIG. 3 shows an alternative embodiment of the present invention.

FIG. 3 is generally similar to FIG. 2, but illustrating an alternative embodiment of the present invention. As compared to FIG. 2, where the manually operated bulb 64 is connected to draw a vacuum in line 60, FIG. 3 shows an embodiment where the manually operated bulb 64 is connected to the fuel supply module 40 to create an increased pressure therein. This increased pressure raises the pressure in the fuel filter 22 and causes the water 50 to flow downwardly from the fuel filter 22 and through conduit 60 in an upward direction. Comparing FIGS. 2 and 3, it can be seen that position 118 of the selectable valve 110 is a direct connection to a drain conduit that directs water toward the temporary container 98 without the necessary involvement of a manually operated bulb 64 located therebetween.

With continued reference to FIG. 3, one of two alternative methods is used to prevent the dissipation of pressure from the fuel filter 22 when this particular embodiment of the present invention is used. Since it is important that pressure be created above the water 50 in the fuel filter 22 so that the water will be induced to flow through conduit 60, one of two check valve systems is used in conjunction with the embodiment shown in FIG. 3. A check valve 133 can be provided in fuel line 48 to maintain the pressure within the fuel filter 22. Alternatively, if a manually operated bulb 135 is used to draw fuel from the fuel tank 24, that manually operated bulb 135 can serve the function of a check valve for these purposes.

Comparing the embodiments illustrated in FIGS. 2 and 3, it can be seen that the embodiment in FIG. 2 creates a suction in line 60 so that the pressure above the water 50 is greater than the pressure in line 60 to draw water toward the container 98. The embodiment in FIG. 3 creates an increased pressure above the fuel in the reservoir 40 so that the pressure above the water 50 in the fuel filter 22 is greater than the pressure in conduit 60. Both of these embodiments result in the flow of the water 50 through conduit 60 toward the container 98.

Although the present invention has been described with considerable specificity and illustrated to show a particularly preferred embodiment, it should be understood that alternative embodiments are also within its scope.

We claim:

1. A marine propulsion device, comprising:
an engine;
a drive shaft housing;
an adapter plate disposed beneath said engine and above said drive shaft housing;
a fuel filter which is connectable between a fuel tank and a fuel pump, said fuel filter being disposed at a location which is external to a space under a cowl of said marine propulsion device;
a conduit connected in fluid communication with said fuel filter; and
a manually operable pump connected in fluid communication with said conduit, said conduit extending through said adapter plate.

2. The marine propulsion device of claim 1, wherein:
said location is below said adapter plate with said adapter plate disposed between said fuel filter and said engine.

3. The marine propulsion device of claim 1, further comprising:
a fuel reservoir, said fuel filter being connected in fluid communication between said fuel reservoir and said fuel tank.

4. The marine propulsion device of claim 3, wherein:
said fuel pump is disposed within said fuel reservoir.

5. The marine propulsion device of claim 1, wherein:
said fuel filter has an inlet port, an outlet port, and a filter media disposed in fluid communication between said inlet and outlet ports.

6. The marine propulsion device of claim 5, further comprising:
a purge pump; and
a conduit connected in fluid communication between a purge port of said fuel filter and said purge pump.

7. The marine propulsion device of claim 6, wherein:
said conduit extends through said adapter plate.

8. The marine propulsion device of claim 6, wherein:
said filter media is disposed in fluid communication between said purge port and said outlet port of said fuel filter.

9. The marine propulsion device of claim 6, wherein:
said inlet port is said purge port.

10. The marine propulsion device of claim 6, wherein:
said purge pump is a manually operable pump.

11. The marine propulsion device of claim 6, wherein:
said purge pump comprises a compressible bulb.

12. The marine propulsion device of claim 6, further comprising:
a valve connected in fluid communication with said conduit.

13. A marine propulsion device, comprising:
an engine;
a drive shaft housing;
an adapter plate disposed beneath said engine and above said drive shaft housing;
a water separating fuel filter which is connectable between a fuel tank and a fuel pump, said water separating fuel filter being disposed below said adapter plate with said adapter plate disposed between said water separating fuel filter and said engine, said water separating fuel filter having an inlet port, an outlet port, and a filter media disposed in fluid communication between said inlet and outlet ports;
a purge pump; and
a conduit connected in fluid communication between a purge port of said water separating fuel filter and said purge pump.

14. The marine propulsion device of claim 13, further comprising:
a fuel reservoir, said water separating fuel filter being connected in fluid communication between said fuel pump and said fuel tank.

15. The marine propulsion device of claim 13, wherein:
said conduit extends through said adapter plate; and
said filter media is disposed in fluid communication between said purge port and said outlet port of said water separating fuel filter.

16. The marine propulsion device of claim 15, wherein:
said inlet port is said purge port.

17. The marine propulsion device of claim 15, wherein:
said purge pump is a manually operable pump.

18. The marine propulsion device of claim 17, wherein:
said purge pump comprises a compressible bulb.

19. The marine propulsion device of claim 18, further comprising:
a valve connected in fluid communication with said conduit.

* * * * *